US009123495B2

(12) United States Patent
Bertrand

(10) Patent No.: US 9,123,495 B2
(45) Date of Patent: Sep. 1, 2015

(54) AUXILIARY TRIP DEVICE FOR TRIPPING A CIRCUIT BREAKER

(71) Applicant: SCHNEIDER ELECTRIC INDUSTRIES SAS, Rueil Malmaison (FR)

(72) Inventor: Mickael Bertrand, Grenoble (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 8 days.

(21) Appl. No.: 14/082,723

(22) Filed: Nov. 18, 2013

(65) Prior Publication Data

US 2014/0139301 A1 May 22, 2014

(30) Foreign Application Priority Data

Nov. 19, 2012 (FR) ..... 12 03097

(51) Int. Cl.

| | |
|---|---|
| ***H01H 9/00*** | (2006.01) |
| ***H01H 71/24*** | (2006.01) |
| ***H01H 71/02*** | (2006.01) |
| *H01H 83/12* | (2006.01) |
| *H01H 83/20* | (2006.01) |

(52) U.S. Cl.

CPC ..... *H01H 71/24* (2013.01); *H01H 71/0228* (2013.01); *H01H 71/2463* (2013.01); *H01H 83/12* (2013.01); *H01H 2083/205* (2013.01)

(58) Field of Classification Search

CPC ..... H01H 71/505

USPC ..... 335/172, 167

See application file for complete search history.

(56) References Cited

U.S. PATENT DOCUMENTS

| | | | | |
|---|---|---|---|---|
| 1,432,433 | A * | 10/1922 | Aalborg | 74/2 |
| 5,343,179 | A | 8/1994 | Pipich et al. | |
| 5,512,720 | A | 4/1996 | Coudert et al. | |
| 5,946,179 | A * | 8/1999 | Fleege et al. | 361/42 |

FOREIGN PATENT DOCUMENTS

GB 2 274 744 A 8/1994

OTHER PUBLICATIONS

French Preliminary Search Report issued Jul. 17, 2013, in French Application No. 12 03097 filed Nov. 19, 2012 (with English Translation of Categories of Cited Documents).

* cited by examiner

*Primary Examiner* — Alexander Talpalatski

(74) *Attorney, Agent, or Firm* — Oblon, McClelland, Maier & Neustadt, L.L.P.

(57) ABSTRACT

An auxiliary trip unit for a circuit breaker comprises:

a drive part with a movable blade, a latch fitted pivoting around a swivelling axis and designed to secure the blade in a neutral position, against a flexible bias force, until movement of the latch takes place to a released position, a nose of the latch salient in a direction passing through the swivelling axis so as to comprise a salient end where positive latching of the blade on the latch takes place in the neutral position.

The latch collaborates with the blade to receive a thrust force acting in the direction of resetting of the latch to its latching position.

4 Claims, 5 Drawing Sheets

AUXILIARY TRIP DEVICE FOR TRIPPING A CIRCUIT BREAKER

BACKGROUND OF THE INVENTION

The invention relates to an auxiliary trip unit designed to be associated with a circuit breaker so as to be able to trip this circuit breaker, which can for example be a moulded case circuit breaker.

STATE OF THE ART

A circuit breaker generally comprises a circuit breaker operating mechanism and a trip bar movable between a latched position and an unlatched position. The circuit breaker also comprises at least one main trip unit, which is designed to actuate the trip bar to make it leave its latched position.

When the trip bar is in the latched position, the circuit breaker operating mechanism is secured in a passive state where it is inoperative on the tripped or non-tripped state of the circuit breaker. If it detects an abnormal electric condition such as a persistent overcurrent or a short-circuit, the main trip unit actuates the trip bar to the unlatched position. Movement of the trip bar to its unlatched position causes breaking of the latching of the circuit breaker operating mechanism which is then released, resulting in tripping of the circuit breaker, i.e. in opening of the latter.

In certain single-phase or multiphase circuit breakers, the main trip unit can be completed by an auxiliary trip unit which, like the main trip unit, is able to cause breaking of the latching of the circuit breaker operating mechanism. This auxiliary trip unit can thus perform opening of the circuit breaker independently from the position of the main trip unit. Such an auxiliary trip unit can be controlled electrically, which can in particular be used to enable remote control of the circuit breaker.

For example, it may be desired to associate and/or combine with the circuit breaker an auxiliary trip unit of a first type which permanently detects the presence or absence of a voltage and which is designed to cause tripping of the circuit breaker if this voltage becomes unavailable or drops below a predefined threshold. Such an auxiliary trip unit of the first type is commonly called "auxiliary trip unit MN with undervoltage release" or "undervoltage auxiliary trip unit MN".

In combination with a circuit breaker, it is also possible to use an auxiliary trip unit of a second type which is designed to cause tripping of the circuit breaker if an electric current higher than a predefined level is flowing in this auxiliary trip unit. Such an auxiliary trip unit of the second type is commonly called "auxiliary trip unit MX with overvoltage release" or "overvoltage auxiliary trip unit MX".

The document U.S. Pat. No. 5,512,720 proposes two auxiliary trip units for a moulded case circuit breaker, viz. an auxiliary trip unit of the first type, with undervoltage tripping, and an auxiliary trip unit of the second type, with overvoltage tripping. In these auxiliary trip units MN and MX, an energy storage mechanism comprises a swivelling latch design to secure a blade in a neutral position, against a flexible bias tending to make this blade change position with a movement causing tripping of the circuit breaker. When the energy storage mechanism is loaded, the blade is secured in its neutral position due to the fact that it is latched to the latch. This latching is releasable, i.e. easy to undo when tripping takes place.

The strength of the releasable latching must not be too far from a target value. If this latching strength is too weak, there is in fact a risk of accidental unlatching resulting in nuisance tripping of the circuit breaker. On the contrary, too great a strength of the releasable latching runs the risk of the latching resisting an unlatching command, resulting in the risk of tripping not taking place in the presence of an order on the contrary commanding tripping of this circuit breaker.

Several parameters do however play a part in the strength of the releasable latching in the auxiliary trip units described by the above-mentioned document U.S. Pat. No. 5,512,720. One of these parameters concerns the precision with which the latch can be formed at the level of its latching to the blade, all the more so as this area has small dimensions. In similar manner, another parameter involved in the strength of the releasable latching concerns the precision with which the blade can be formed at the level of its latching area to the latch, all the more so as this area is located at the level of an edge achieved by shearing. Furthermore, the strength of the releasable latching in the auxiliary trip units described by above-mentioned U.S. Pat. No. 5,512,720 is a function of the balance between the two flexible biases. One of these biasing forces is exerted on the blade and tends to make this blade move in the direction of a tripping movement of the circuit breaker. The other bias involved in the above-mentioned balance is exerted on the latch. It is due to a spring designed to make the latch return to its latching position when resetting of the auxiliary trip unit takes place. Copies of this spring are complicated to manufacture and significant variations of properties between such copies of the spring are observed.

It is apparent from the foregoing that, already individually, each of the parameters involved in the mechanical strength of the releasing latchings provided in the above-mentioned U.S. Pat. No. 5,512,720 can be difficult to master. Combination of the set of these parameters is even more difficult to master. This has the result that, when auxiliary trip units identical or similar to those described in the above-mentioned U.S. Pat. No. 5,512,720 are manufactured, considerable adjustment problems are encountered as far as the strength of the releasable latching is concerned.

OBJECT OF THE INVENTION

The object of the invention is to facilitate management of production of an auxiliary trip unit of a circuit breaker.

According to the invention, the auxiliary trip unit comprises:

- a drive part with a blade that is movable between a neutral position and an active position,
- at least one flexible actuating means provided to store mechanical energy when the drive part is in its neutral position, and to actuate the drive part from its neutral position to its active position, by means of said energy, with a movement producing a tripping operation of the circuit breaker, following unlatching of the drive part,
- a latch fitted swiveling around a swiveling axis and designed to secure the drive part in its neutral position, against a releasing of said energy, until movement of the latch takes place to a releasing position in which said unlatching takes place,
- a first bias spring fitted to bias the latch to a latching position in which the latch secures the drive part in its neutral position,
- a thrust slide to propel the latch out of its latching position to its released position,
- a second bias spring fitted to bias the slide in a first direction,
- an electric coil generating an electromagnetic force to drive the slide against the second bias spring, in a second direction opposite to the first direction, when this coil is supplied by said electric command, a nose of the latch being salient in a direction passing through the swivelling axis so as to comprise a salient end where localized latching of the blade on the latch takes place when this latch in its latching position secures the blade in its neutral position.

The latch is configured such as to be able to receive, from the drive part, a thrust force acting in the direction of resetting of the latch to its latching position.

The auxiliary trip unit defined above can incorporate one or more other advantageous features, either alone or in combination, in particular among those defined hereunder.

the latch further comprises a push-rod designed to receive said thrust of the drive part and of the blade;

the latch comprises a first branch forming a finger provided with said nose;

the latch comprises a second branch angularly offset from the first branch around said swivelling axis and placed on the path of the slide so as to be able to receive, from the slide, an actuating thrust in the direction of the releasing position, said second branch comprising said push-rod;

the first bias spring comprises an actuating arm by means of which the first bias spring acts directly on the second branch of the latch, the push-rod forming at least one terminal portion of a hook on which the actuating arm constituting the first bias spring is latched;

the second bias spring exerts a bias on the slide to actuate the latch from its latching position to its released position.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF PREFERRED EMBODIMENTS OF THE INVENTION

Figure 1:
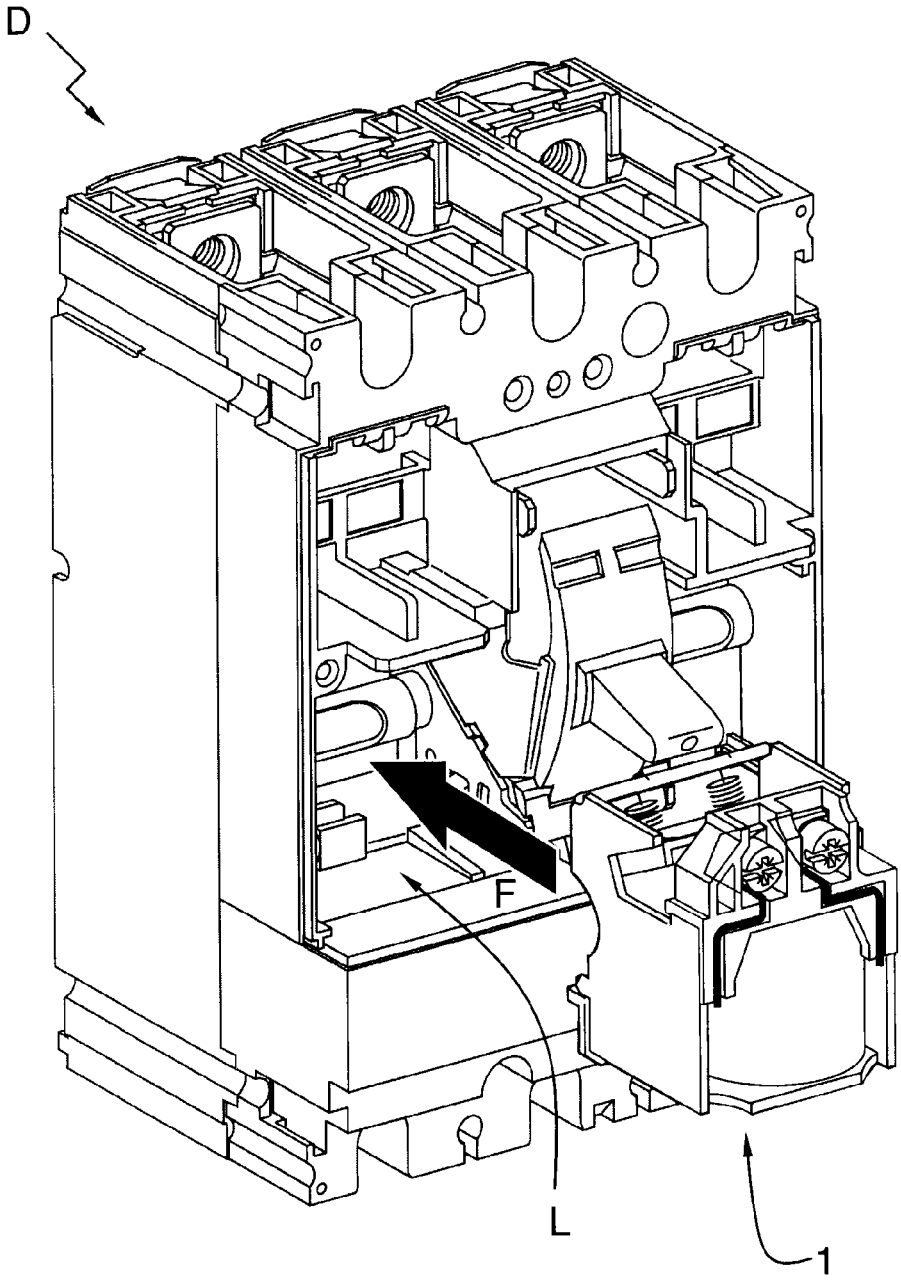
FIG. 1 is an exploded perspective view of an auxiliary voltage trip unit according to the invention and of a circuit breaker designed to receive this trip unit.

FIG. 1 represents an auxiliary trip unit 1 according to the invention, and also a multiphase circuit breaker D able to be equipped with the latter. In the example represented, auxiliary trip unit 1 is a modular optional equipment unit with which circuit breaker D can be equipped or not.

Again in the represented example, circuit breaker D is more precisely a moulded case circuit breaker, which can be designated by the initials MCCB (standing for Moulded Case Circuit Breaker). It can however be of a different nature without departing from the scope of the invention.

In FIG. 1, auxiliary trip unit 1 is represented outside the case of circuit breaker D. The arrow F schematically indicates fitting of the latter in a complementary fitting and connection housing L that circuit breaker D comprises to accommodate this auxiliary trip unit 1 in operational manner.

Figure 2:
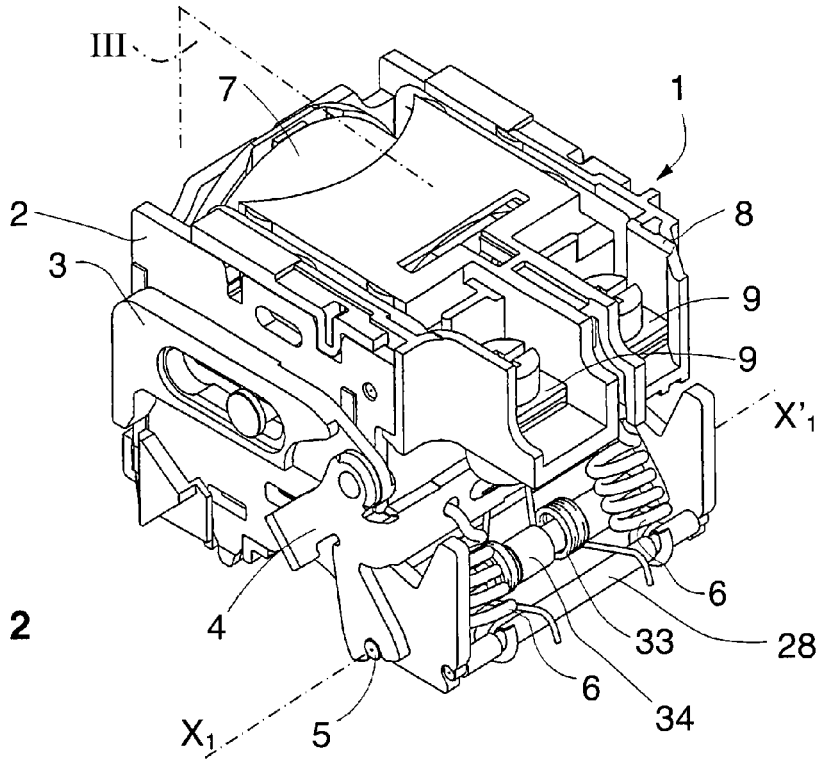
FIG. 2 is a perspective view of the auxiliary trip unit represented outside the circuit breaker of FIG. 1.

Auxiliary trip unit 1 is represented alone in FIG. 2. It is more precisely a voltage trip unit which comprises a case 2 for assembly and support in fixed or movable manner of most of the other elements constituting auxiliary trip unit 1. Certain of these other elements form an energy storage mechanism having a drive part 3 associated with a blade 4 fitted swiveling with respect to case 2 by means of two opposite bearings 5. The energy storage mechanism also comprises one more flexible actuating members 6, which have the function of actuating blade 4 to an active position thereby causing tripping of circuit breaker D. In the represented example, these flexible actuating members 6 are two in number and are formed by two tension springs fitted in parallel so as to act in conjunction with one another in the same direction.

Auxiliary trip unit 1 comprises an electromagnetic actuating device which includes an electric coil 7. Auxiliary trip unit 1 also comprises a terminal block 8 supporting two electric terminals 9 performing electric connection of coil 7 to wires performing electric command transmission, these wires not being represented.

Figure 3:
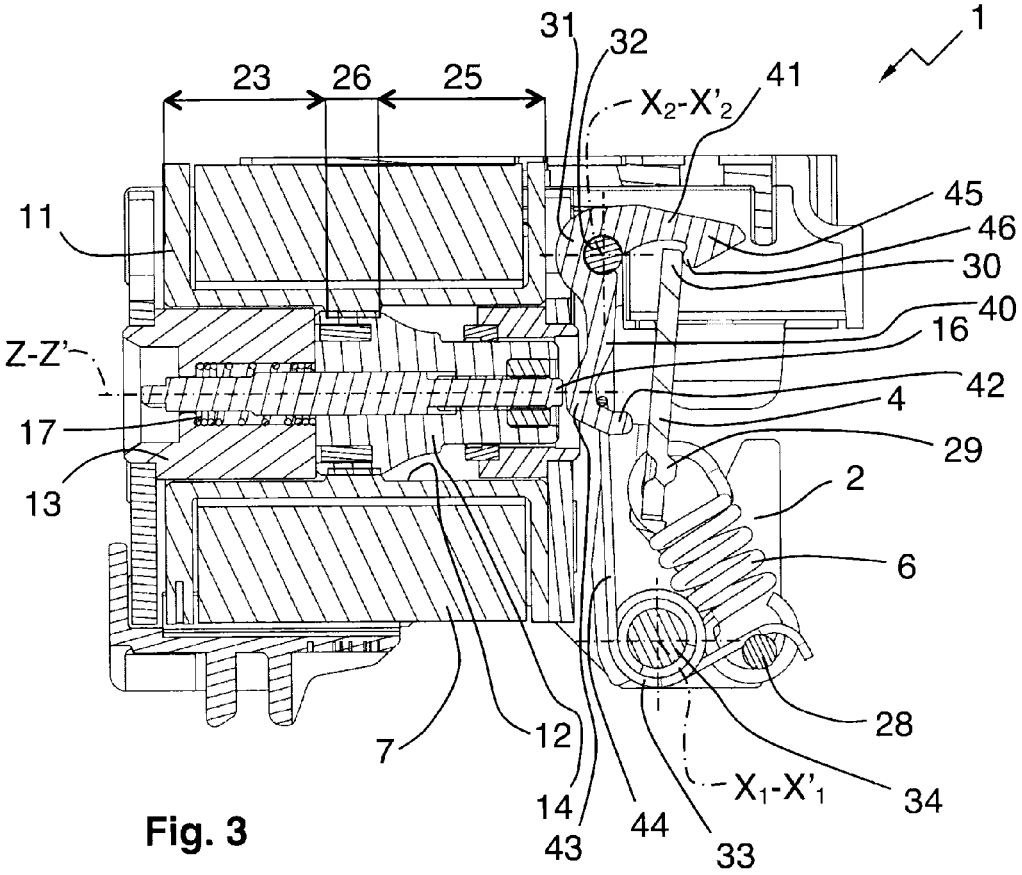
FIG. 3 is a longitudinal cross-sectional view along the line III of FIG. 2 and, like this FIG. 2, only represents the auxiliary trip unit, which is more precisely a trip unit of the first type, i.e. an undervoltage trip unit.

Auxiliary trip unit 1 is more precisely an undervoltage auxiliary trip unit MN. As can be seen in FIG. 3, coil 7 is housed in a support sheath 11. An axial passage 12 passes longitudinally through sheath 11 inside which there are fitted a fixed core 13 and a slide comprising moving core 14 and a push-rod 16 rigidly secured to one another by screw-fastening. This slide is guided to slide in a sliding direction Z-Z'.

A compression spring 17 is fitted inside sheath 11 and is compressed between a rim in fixed core 13 and an end surface of moving core 14. It tends to move moving core 14 away from fixed core 13 in the sliding direction Z-Z'. In other words, spring 17 constitutes a part performing flexible biasing of moving core 14 away from fixed core 13.

One end of push-rod 16 extends beyond moving core 14 so as to form an axially salient actuating finger. Opposite this actuating finger, a portion of push-rod 16 also extends beyond moving core 14. Fixed core 13 has passing through it an axial hole in which this portion passes, on which spring 17 is fitted being surrounded by fixed core 13.

Axial passage 12 comprises three sections 23, 25 and 26 which succeed one another axially. Section 26 is a middle section of smaller diameter connecting sections 23 and 25 to one another, which sections open out in two axially opposite directions and which advantageously have the same diameter.

In addition to blade 4 and one of tension springs 6, other constituent components of the energy storage mechanism referred to in the above in relation with FIG. 2 can be seen in FIG. 3. In the enlargement constituted by FIG. 4, the way the constituent components of this energy storage mechanism are arranged and how they operate in conjunction with one another can be seen even better.

Blade 4 is designed to drive trip member 3 designed to collaborate with a trip bar to the unlatched position. When this unlatched position is reached, disengagement of a circuit breaker operating mechanism present in circuit breaker D takes place. In a manner known as such, this disengagement leads to tripping and to opening of the contacts of circuit breaker D.

As has been already mentioned in the foregoing, blade 4 is fitted swivelling around an axis referenced $X_1$-$X'_1$. The two tension springs 6 serve the purpose of accumulating energy in order to actuate blade 4 from its position of FIGS. 3 and 4 where auxiliary trip unit 1 is in a neutral loaded state. Each spring 6 has two opposite ends which are both curved so as to form a hook and which are a fixed anchoring end attached to a fixed securing bar 28 and a movable actuating end attached to a coupling part 29 of part 4.

Blade 4 comprises a latching end 30 which is located away from swivelling axis $X_1$-$X'_1$ so as to able to rotate around this axis when blade 4 is actuated.

The energy storage mechanism further comprises a swivelling latch 31 which is supported by a shaft 32 so as to be able to pivot around a swivelling axis $X_2$-$X'_2$ substantially parallel to swivelling axis $X_1$-$X'_1$.

Figure 4:
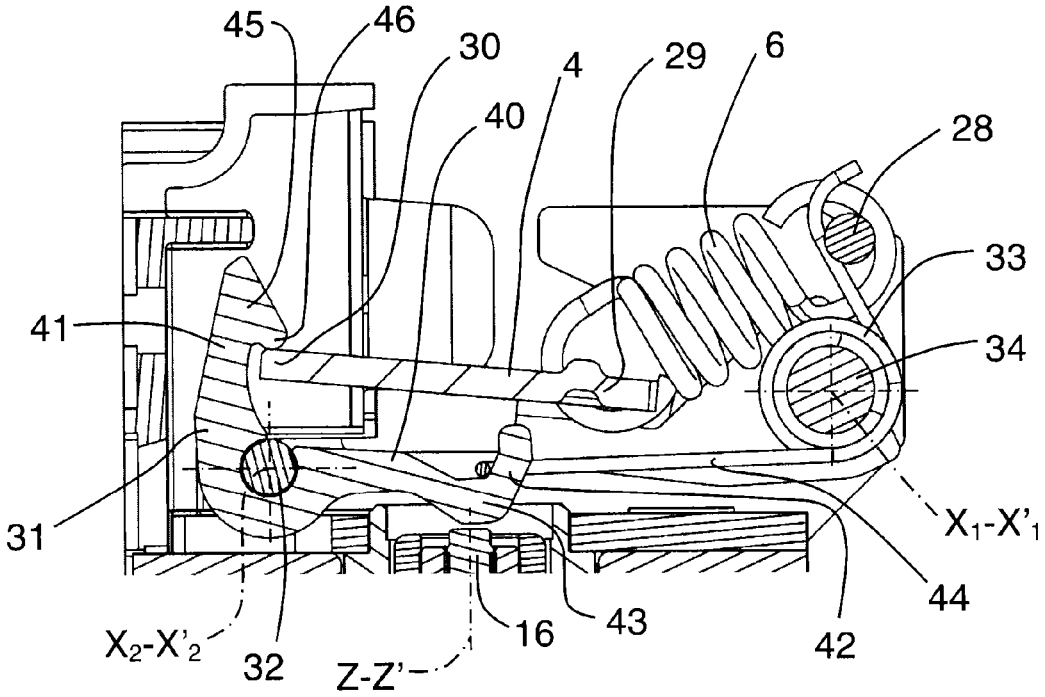
FIG. 4 is an enlargement of a portion of FIG. 3, where the auxiliary trip unit of FIG. 2 is in a first state, i.e. a neutral loaded state.

A spring 33 biases latch 31 permanently around swivelling axis $X_2$-$X'_2$ (in the clockwise direction in FIGS. 3 and 4). Spring 33 is wound around a bar 34 each end of which forms part of one of bearings 5. Two branches of spring 33 are permanently pressing against fixed retaining bar 28 which prevents them from swivelling around bar 34, in the clockwise direction in FIG. 3.

Figure 5:
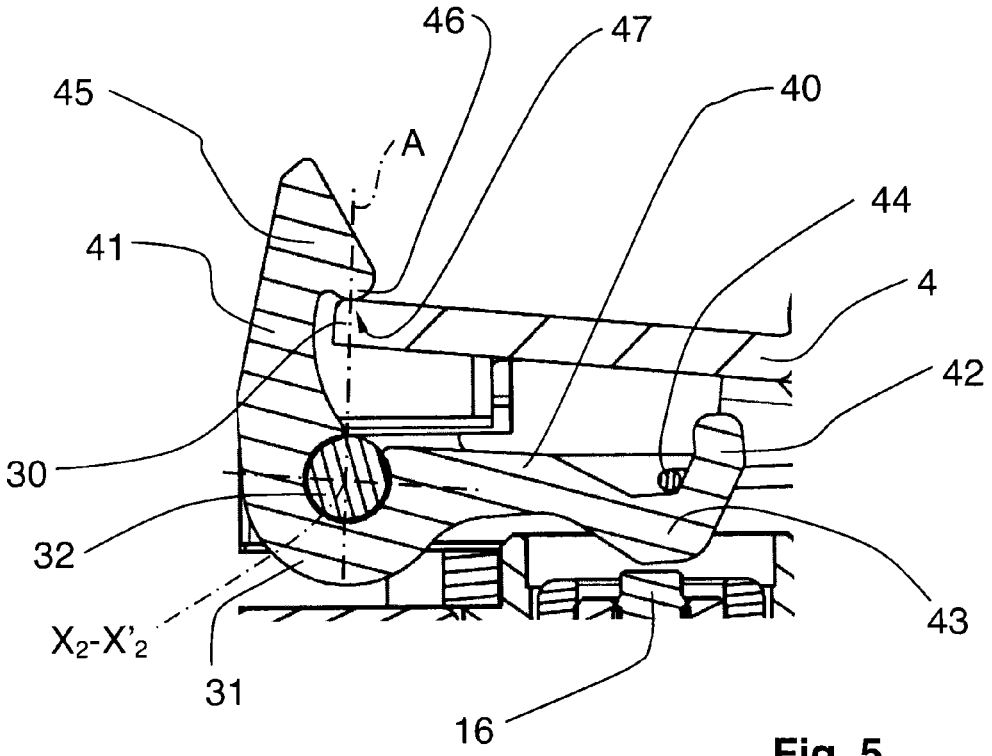
FIG. 5 is an enlargement of a window which is a selection of a portion of FIG. 4.

As can be seen in FIG. 5, latch 31 comprises two branches 40 and 41 angularly offset from one another around swivelling axis $X_2$-$X'_2$. Branch 40 is located on the path of push-rod 16, which can thus exert a thrust on the latter actuating latch 31 from a latched position to a released position. At the level of its free end, branch 40 is terminated by a push-rod 42, which is globally directed towards part 4 so as to be able to receive an actuating thrust from this part 4. In addition to this push-rod 42, latch 31 comprises an elbow 43 the dish-shaped part of which is facing part 4. Opposite this part 4, the elbow comprises a salient back which defines a receiving area of a thrust exerted by push-rod 16 on each tripping.

Spring 33 comprises an actuating arm 44 by means of which it acts on latch 31 by pushing on branch 40 of the latter. Push-rod 42 and elbow 43 together form a hook to which actuating arm 44 is latched in robust manner.

Branch 41 of latch 31 forms a latching finger terminated by a latching head 45 provided to secure blade 4 by latching in a neutral position, i.e. in the position of FIGS. 3 to 5 where the energy storage mechanism is loaded. Latching head 45 comprises a nose 46 where latching of part 4 takes place. As can be seen in FIG. 5, nose 46 is globally salient in a direction A passing through swivelling axis $X_2$-$X'_2$. In this manner, it comprises a salient end 47 where pressing of part 4 takes place when this part 4 is latched on latch 31 in its latching position. In the represented example where latch 31 is provided with nose 46, the latter is more precisely salient towards swiveling axis $X_2$-$X'_2$. As an alternative, it can be imagined that nose 46 is supported by part 4, in which case it is globally directed in the opposite direction from swivelling axis $X_2$-$X'_2$.

In FIG. 3, an electric excitation current flows continuously through coil 7 so that the generated electromagnetic force maintains moving core 14 against fixed core 13. The actuating finger formed by one end of push-rod 16 is then located at a small distance, called "clearance", from branch 40 of latch 31.

In FIG. 3 as in FIGS. 4 and 5, the energy storage mechanism of auxiliary trip unit 1 is loaded in so far as blade 4 is latched on latch 31 located in its latching position. Latch 31 therefore secures blade 4 in a neutral position, against a bias force exerted by the two springs 6 together. These two springs 6 thus store energy able to actuate blade 4 to an active position.

Pressing of blade 4 on latch 31 is localized at salient end 47 when this latch 31 performs latching of the energy storage mechanism in a loaded state, as is the case in FIGS. 3 to 5. This results in this latching being stable, unlike latching resulting from unlocking securing. A stable securing producing a stable latching is also called locking. This involves positive latching insensitive to variations liable to affect different construction parameters. In other words, a locking latching is dependable, without any risk of accidental releasing, even in the presence of such variations which may concern the dimensions of the parts and/or of the adjustments of position and/or the stiffness of the springs.

When it is in its latching position, latch 31 is subjected to two opposing torques with respect to swivelling axis $X_2$-$X'_2$. Being subjected to the tractions of the two springs 6, blade 4 exerts a first of these two torques on latching head 45. Actuating arm 44 exerts the second torque on latch 31. However, the force exerted by this actuating arm 44 can be chosen so as to be weak. This force cannot take part in the latching performed by latch 31 as this latching results from a stable or locking latching.

If the excitation current flowing in coil 7 is interrupted or drops below a predefined threshold, i.e. if the voltage at the terminals of said coil 7 drops to zero or below a predefined threshold, the compression force of first spring 17 becomes greater than the attraction force of moving core 14 towards fixed core 13. Push-rod 16 is then driven towards branch 40 of latch 31 until it pushes this branch 40 at the level of the back of elbow 43 thereby making latch 31 pivot to its released position.

Figure 6:
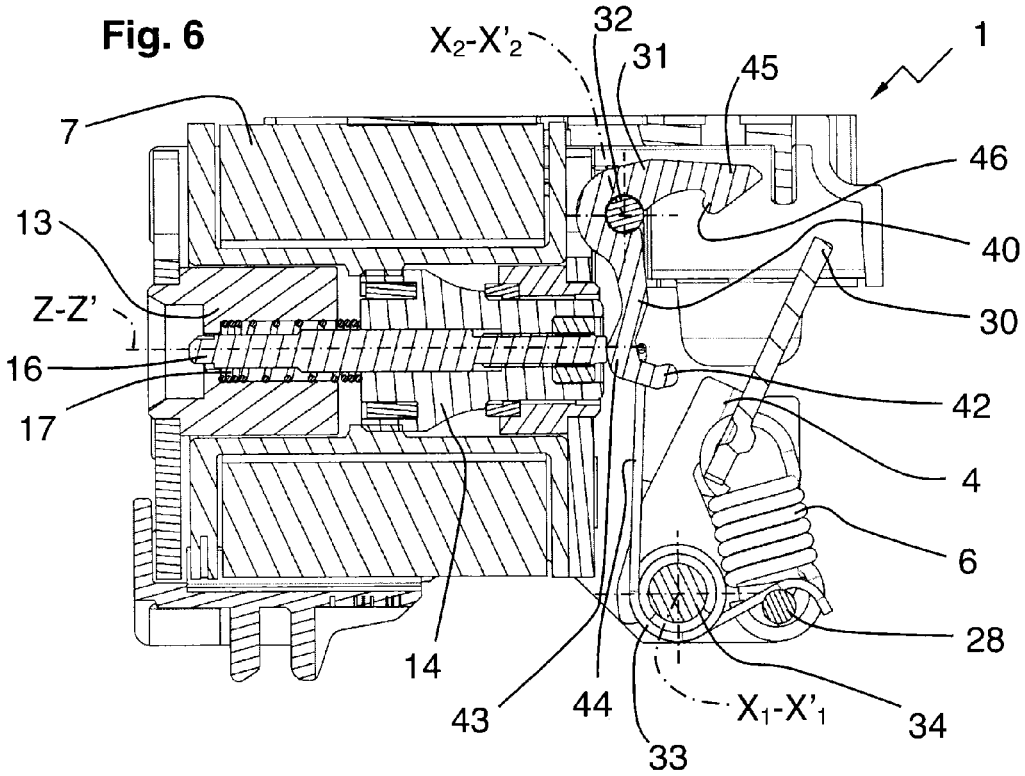
FIG. 6 is a longitudinal cross-sectional view that is similar to FIG. 3 and where the auxiliary trip unit of FIGS. 2 and 3 is in a second state, i.e. a tripped state, after it has caused tripping of the circuit breaker of FIG. 1.

When actuation of latch 31 takes place from its latched position to its released position, blade 4 is released from this latch 31 causing unlatching of the energy storage mechanism. Following this unlatching, springs 6 retract due to the energy stored by them being released, and they together drive blade 4 from its neutral position of FIG. 3 to its active position of FIG. 6. When moving from its neutral position to its active position, blade 4 performs a movement causing tripping of circuit breaker D. More precisely, blade 4 then drives trip member 3 in translation, which in turn moves the trip bar of circuit breaker D to a position where effective tripping of this circuit breaker D is performed. FIG. 6 illustrates the state of auxiliary trip unit 1 on completion of tripping of its energy storage mechanism, i.e. on completion of movement of blade 4 to its active position due to the action of springs 6.

Figure 7:
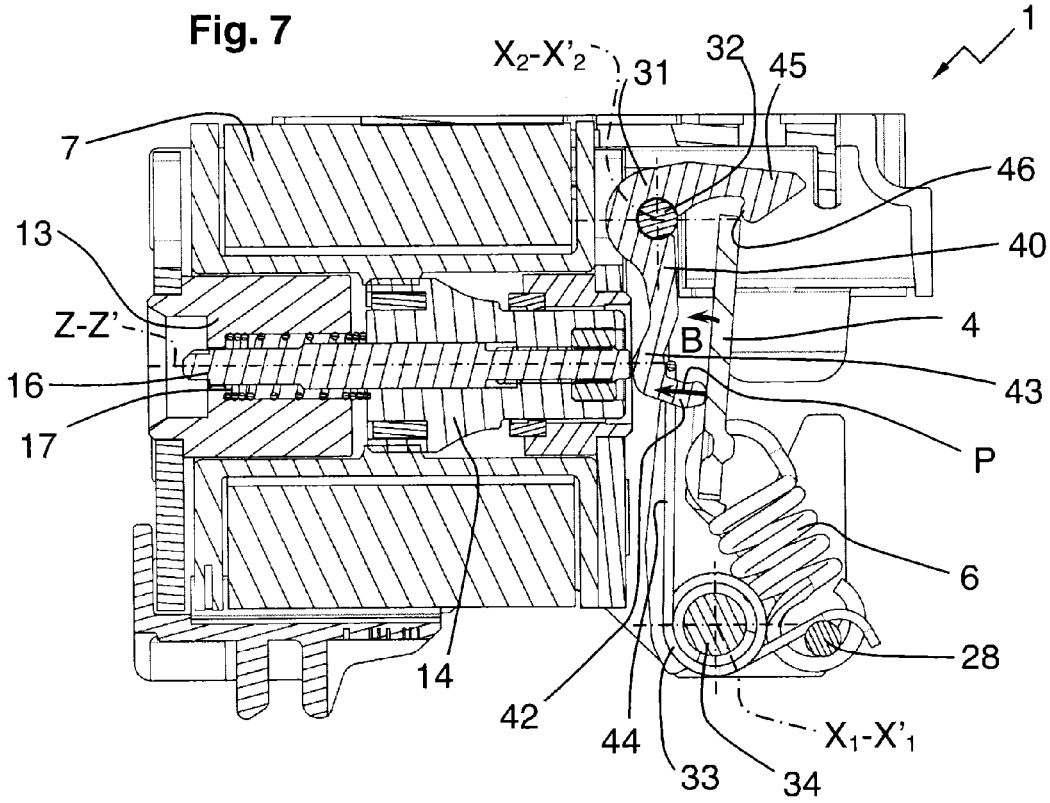
FIG. 7 is a longitudinal cross-sectional view that is similar to FIG. 3 like FIG. 6, and where the auxiliary trip unit of FIGS. 2 and 3 is in the process of being reset, i.e. actuated from its tripped state to its neutral loaded state.

FIG. 7 illustrates resetting of the energy storage mechanism of auxiliary trip unit 1 after tripping that has led to the state of FIG. 6. This resetting can be successfully performed after coil 7 has been repowered on. Once it has been correctly repowered, coil 7 produces an electromagnetic force acting on moving core 14 in the direction of return of this moving core towards fixed core 13. This electromagnetic force is lower than that exerted by spring 17, so long as moving core 14 is too far away from fixed core 13. In other words, correct repowering of coil 7 is insufficient on its own to effectively make moving core 14 return towards fixed core 13.

After coil 7 has been correctly repowered, resetting of the energy storage mechanism of auxiliary trip unit MN results from resetting of circuit breaker D. Such a resetting of circuit breaker D is due to manual actuation of the handle generating a movement which is transmitted to blade 4 so that the latter moves to its neutral position. This takes place in FIG. 7, where movement of blade 4 to its neutral position is symbolized by the arrow B. When performing its swivelling movement B, blade 4 exerts a thrust force P towards fixed core 13, on push-rod 42 of branch 40, which transmits this thrust force P to push-rod 16 of the slide. Transmitted by branch 40, thrust force P repels this slide towards fixed core 13. When the slide is sufficiently depressed in the direction of fixed core 13, the electromagnetic force generated by coil 7 on moving core 14 becomes greater than the force produced by spring 17, after which it is able to drive moving core 14 in the direction of a return towards fixed core 13 after thrust force P has disappeared.

When moving core 14 is driven by coil 7 only, without any thrust force P, swivelling of latch 31 to its latching position continues due to the effect of the flexible bias produced by spring 33. The end of resetting of circuit breaker D results in stopping of an action on blade 4 against springs 6, which then make blade 4 latch onto nose 46 of latching head 45. After this, the energy storage mechanism of auxiliary trip unit MN is reset, i.e. in its state in FIGS. 3 to 5.

Coil 7 consumes a low electric power to create the force that is just sufficient to keep spring 17 compressed, the latter in fact being able to present a very low stiffness and, in spite of this, to be able to actuate latch 31, if applicable by means of the clearance between push-rod 16 and latch 31.

An auxiliary trip unit of the prior art is represented in FIG. 2 of the document U.S. Pat. No. 5,512,720 where a reference 40 designates a pressing and adjustment part. A compression spring similar to spring 17 is compressed between this pressing and adjustment part and a moving core similar to moving core 14. The pressing and adjustment part provided in document U.S. Pat. No. 5,512,720 is fitted by screw-fastening inside a fixed core similar to fixed core 13. In this manner, its axial position with respect to the fixed core can be adjusted thereby adjusting the bias force exerted by the compression spring. Unlike the fixed core of the trip unit represented in FIG. 2 of the document U.S. Pat. No. 5,512,720, fixed core 13 of auxiliary trip unit 1 according to the invention can be devoid of a pressing and adjustment part serving the purpose of adjusting the compression ratio of the spring which biases moving core 14 away from fixed core 13. This is the case in the represented example and it results in an advantage in particular in terms of simplification and production cost. Another choice consisting in enabling adjustment of the flexible bias of moving core 14 can also be made without departing from the scope of the invention.

Figure 8:
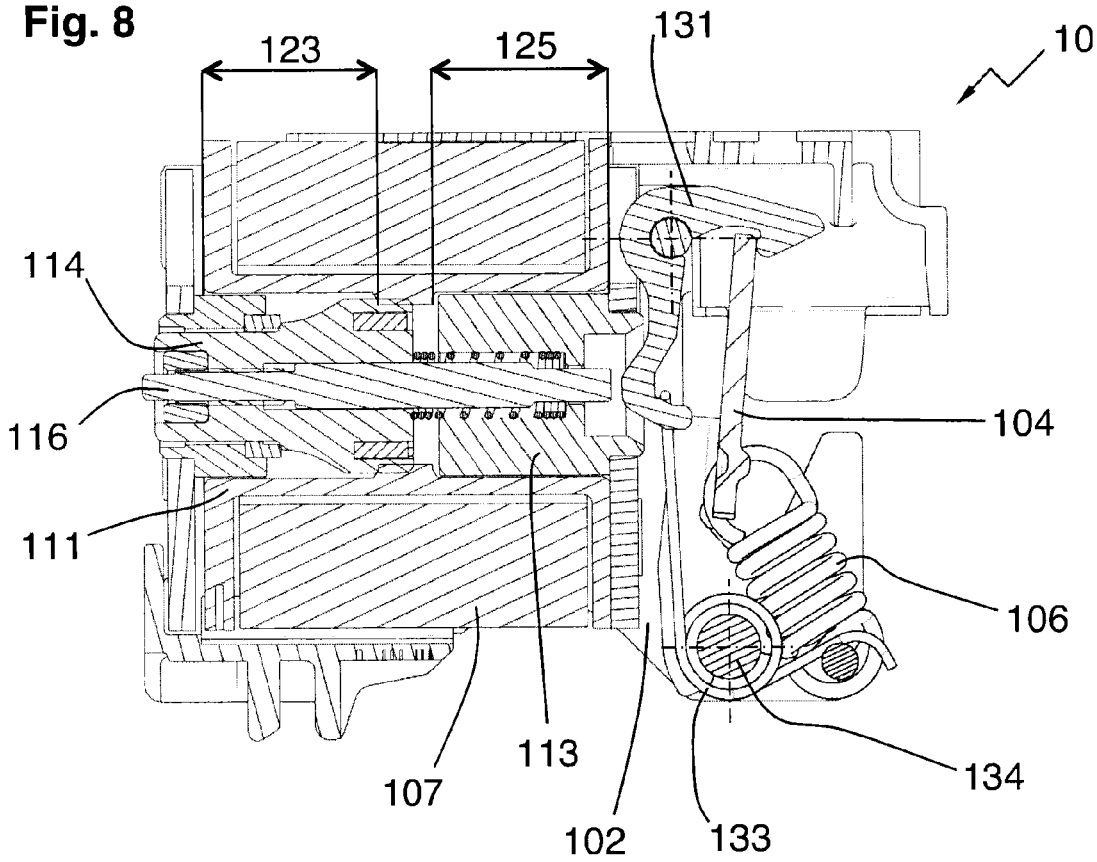
FIG. 8 is a longitudinal cross-sectional view similar to FIG. 3 and represents an auxiliary trip unit which is according to the invention and which is of the second type, i.e. an overvoltage trip unit.

In FIG. 8, another auxiliary trip unit according to the invention is designated by the reference 101. This is more precisely an auxiliary trip unit MX with overcurrent tripping. In the following, only the features differentiating it from auxiliary trip unit 1 are described. Furthermore, a reference used hereafter to designate a part of auxiliary trip unit 101 that is similar or equivalent to a referenced part of auxiliary trip unit 1 is constructed by increasing by one hundred (100) the reference numeral referencing this part on auxiliary trip unit 1.

In advantageous manner, most of the parts of auxiliary trip unit 101 are identical to the parts of auxiliary trip unit 1. This is the case for example of fixed cores 13 and 113 and of moving cores 14 and 114.

Also in advantageous manner, a large part of the parts common to auxiliary trip units 1 and 101 can moreover be fitted in the same manner in the two auxiliary trip units 1 and 101. Such is the case for example of cases 2 and 102, blades 4 and 104, springs 6 and 106, sheaths 11 and 111, push-rods 16 and 116, latches 31 and 131, bars 34 and 134, and springs 33 and 133.

Furthermore, either one of auxiliary trip unit 1 with undervoltage release MN and auxiliary trip unit 101 with overcurrent release MX can be indifferently assembled in operational manner in the complementary fitting and connection housing L of circuit breaker D, which is also advantageous. In other words, circuit breaker D is able to accommodate indifferently either auxiliary trip unit 1 with undervoltage release MN or auxiliary trip unit 101 with overcurrent release MX.

A difference between auxiliary trip units 1 and 101 is that fixed core 13 is fitted in fixed manner in section 23, whereas fixed core 113 is fitted in fixed manner in section 125.

Another difference between auxiliary trip units 1 and 101 is that moving core 14 is mounted sliding axially in section 25, whereas moving core 114 is mounted sliding axially in section 123.

In FIG. 8, auxiliary trip unit 101 is in a neutral loaded state, i.e. in the state in which trip unit 1 is in FIG. 3.

Figure 9:
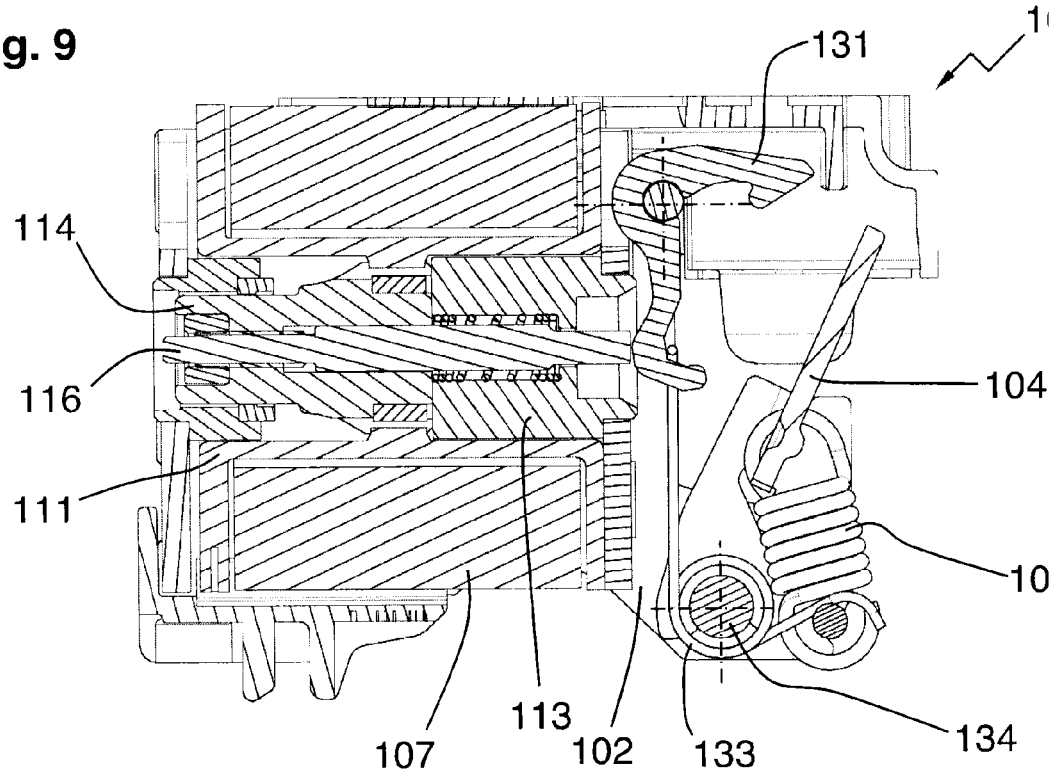
FIG. 9 is also a longitudinal cross-sectional view similar to FIG. 3 and represents the auxiliary trip unit of FIG. 8 in the tripped state, whereas this auxiliary trip unit is in a neutral loaded state in this FIG. 8.

In FIG. 9, auxiliary trip unit 101 is in a tripped state, i.e. in the state in which trip unit 1 is in FIG. 6.

Auxiliary trip unit 101 with undervoltage release MX operates in opposite manner to auxiliary trip unit 1 in that auxiliary trip unit 101 causes tripping of circuit breaker D when an electric command current higher than a predefined threshold starts to flow in a coil 107.

The invention claimed is:

1. An auxiliary trip unit for tripping a circuit breaker according to an electric command, comprising:

a drive part associated with a blade that is movable between a neutral position and an active position;

at least one flexible actuating means designed to store mechanical energy when the blade is in its neutral position, and to actuate it from its neutral position to its active position, by means of said energy, with a movement producing a tripping operation of the circuit breaker, following unlatching of the blade;

a latch fitted swivelling around a swivelling axis and designed to secure the blade in its neutral position, against releasing of said energy, until movement of the latch takes place to a releasing position in which said unlatching takes place;

a first bias spring fitted to bias the latch to a latching position in which the latch secures the blade in its neutral position;

a thrust slide to propel the latch out of its latching position to its released position;

a second bias spring of the slide in a first direction; and an electric coil generating an electromagnetic force to drive the slide against the second bias spring, in a second direction opposite to the first direction, when this coil is supplied by said electric command, wherein the latch comprises a first branch having a latching head with a nose protruding from said latching head in a direction passing through the swivelling axis so as to comprise a salient end forming a localized contact point with the blade, wherein the blade comes in contact with the latch only at said contact point, when said latch secures the blade in the neutral position, and a second branch terminated by a push-rod which is actuated by a thrust force during resetting of the blade to the latching position.

2. The auxiliary trip unit according to claim 1, wherein the second branch of the latch is angularly offset from the first branch around said swivelling axis and placed on the path of the slide so as to be able to receive from the slide an actuating thrust to the released position.

3. The auxiliary trip unit according to claim 1, wherein the first bias spring comprises an actuating arm which acts directly on the second branch of the latch, the push-rod forming at least one terminal portion of a hook on which the actuating arm is latched.

4. The auxiliary trip unit according to claim 1, wherein the second bias spring exerts a bias on the slide to actuate the latch from the latching position to the released position.

* * * * *